United States Patent [19]

Gaston

[11] Patent Number: 4,813,685

[45] Date of Patent: Mar. 21, 1989

[54] GAME METHOD AND APPARATUS WITH REVOLVING DISKS

[76] Inventor: James A. Gaston, P.O. Box 158, Nutting Lake, Mass. 01865

[21] Appl. No.: 137,599

[22] Filed: Dec. 24, 1987

[51] Int. Cl.[4] ..... A63B 67/00

[52] U.S. Cl. ..... 273/414

[58] Field of Search ..... 273/414, 109, 319, 329, 273/330, 331, 332, 333, 334, 335, 413; 446/236, 247, 255

[56] References Cited

U.S. PATENT DOCUMENTS

| | | | |
|---|---|---|---|
| 1,241,000 | 9/1917 | Mulvey | 446/247 |
| 1,932,943 | 10/1933 | Smith | 446/247 |
| 2,189,922 | 2/1940 | Perrier | 273/319 |
| 2,500,253 | 3/1950 | Kimple | 446/236 |
| 2,814,157 | 11/1957 | Williams | 446/247 |
| 3,516,195 | 6/1970 | Batley | 446/254 |
| 3,605,327 | 9/1971 | Jones | 446/247 |

FOREIGN PATENT DOCUMENTS

| | | | |
|---|---|---|---|
| 1109355 | 1/1956 | France | 446/236 |
| 390092 | 3/1933 | United Kingdom | 273/319 |

*Primary Examiner*—William H. Grieb

*Attorney, Agent, or Firm*—Parmelle, Bollinger & Bramblett

[57] ABSTRACT

A game of manual dexterity and skill utilizes a game apparatus comprising a thin elongated flexible cord and a plurality of disks each having a central opening therein loosely accommodated on the flexible cord, with a stop member preventing the disk from sliding off. A variety of play patterns may be established by manipulating the game apparatus to separate the disks and revolve the disks in generally circular paths.

24 Claims, 4 Drawing Sheets

GAME METHOD AND APPARATUS WITH REVOLVING DISKS

FIELD OF INVENTION

The invention herein relates to a method and apparatus of a game of skill and coordination, wherein play patterns including revolving motion of various ones and groups of game pieces are imparted to a plurality of game pieces slideably received on a flexible cord.

BACKGROUND OF INVENTION

People have always enjoyed playing games of skill and dexterity. Often what appears to be a simple game apparatus manipulated in a straightforward manner in fact requires a great deal of dexterity and practice to master. There have been several games wherein the game apparatus involves balls mounted on string. Once such game apparatus is disclosed in U.S. Pat. No. 3,605,327 to Jones. The Jones game includes a string having a plurality of balls fixedly secured thereon at spaced-apart fixed positions thereon. A free end of the string can be manipulated to establish a whirling motion of the balls, with the balls in alignment. Mulvy U.S. Pat. No. 1,241,000 discloses a toy comprising a rubber elastic string having a single ball slideably received thereon between two stop members. The ball may be caused to vibrate in vertical or lateral modes by manipulation of the rubber elastic string, wherein the forces stored in and released from the rubber string contribute to the play.

Smith U.S. Pat. No. 1,932,943 discloses a twin ball toy comprising a string having a ball fixed at each end thereof and a handle at a central point between the balls. Smith's handle permits adjustment of string length, particularly as an aide for persons learning the game. French Patent No. 1,109,355 discloses a similar game, with the string having a handle loop formed at the approximate mid-point and there being provided two additional balls, preferably of different size and weight, which are urged against the end balls during play.

The foregoing games make apparent the interest in activities of skilled manipulation and a desire for new and different games and activities of that character.

SUMMARY OF INVENTION

Accordingly, it is a principal object of the invention herein to provide a game using relatively simple game apparatus, but requiring dexterity and skill in play.

It is an additional object of the invention herein to provide a game of the foregoing character which is adapted for variations in play.

It is a further object of the invention herein to provide a method of playing a game with game apparatus of a given character.

Game apparatus according to the invention herein comprises a thin elongated flexible cord and a plurality of game pieces, conveniently in the form of disks. Each of the game pieces has an opening therein and the game pieces are threaded onto and loosely slideably accommodated on the flexible cord. The game pieces are restrained from sliding off a first free end of the flexible cord, conveniently by a stop member which is larger than the opening in the game piece adjacent thereto or by fixing the end game piece to the cord. A sufficient amount of flexible cord is provided to play the game in the ways described below, as well as in other manners both taught herein and provided by the ingenuity of the user of the game apparatus.

The invention herein is also directed toward a method of playing a game utilizing an apparatus as described above by hand grasping the flexible cord with at least one game piece positioned on the depending free end of the cord while holding at least the next adjacent game piece in the same hand, and moving the hand to cause the game piece at the free end of the cord to revolve in a generally circular path. The method further comprises thereafter releasing the next adjacent game piece from the hand, and continuing to move the hand to cause revolution of the game pieces, with at least two of the game pieces at spaced-apart positions along the cord and revolving out of phase.

According to a preferred embodiment of the apparatus and methods according to the invention herein, four game pieces are provided, and they are placed in revolving motions in either pairs of two or in other various deployments.

Other and more specific objects and features of the invention herein will in part appear from the following description of the preferred embodiment and claims, taken together with the drawings.

DRAWINGS

The same reference numerals refer to the same elements throughout the various figures.

DESCRIPTION OF PREFERRED EMBODIMENT

Figure 1:
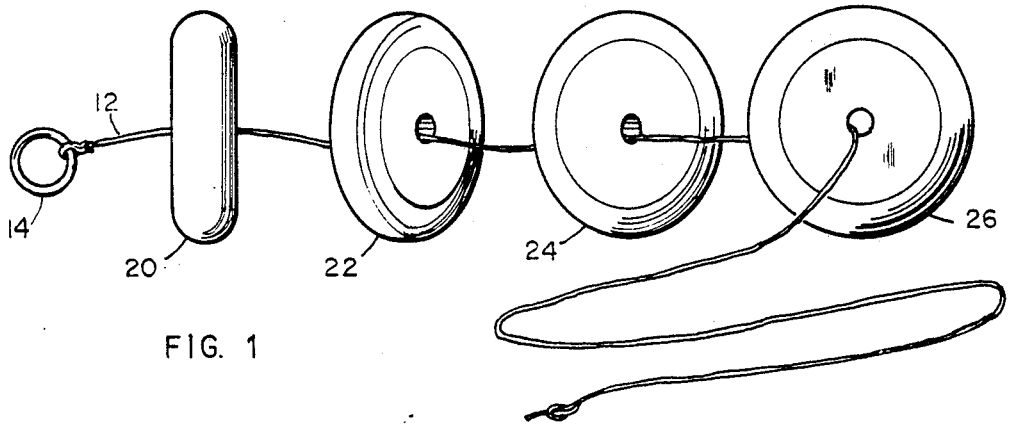
FIG. 1 is a perspective view of a game apparatus according to the invention herein.

With reference to FIG. 1, a game apparatus 10 according to the invention herein comprises an elongated flexible cord 12 having a stop member 14 secured to one end thereof, and four game pieces 20, 22, 24 and 26 slideably received on the flexible cord. The game pieces 20 are in the form of four identical disks approximately five (5) centimeters in diameter and two (2) centimeters thick and have a central opening, e.g. opening 28 in disk 26, which is approximately one half (½) centimeter in diameter. The diameter of the central openings is selected such that the disks slide freely on the flexible cord 12. The disks 20, 22, 24 and 26 may be fabricated of a variety of suitable materials, including wood and plastic. It will be appreciated that the disks can vary in diameter from approximately one (1) centimeter to fifteen (15) centimeters, that the disk thickness can vary from very thin to approximately eight (8) centimeters, and that the shape of the game pieces can also vary from the disk configuration of the preferred embodiment.

The flexible cord 12 is preferably approximately two (2) meters in length and the stop member 14 secured at the end of the cord may be a ring or bead or tab which can be easily secured by a knot about which the cord 20 may be tied. This permits the cord to be replaced easily in the event of wear. For many ways of playing the game, the end game piece 20 may be secured to the cord and thereby function as the stop member for the remaining game pieces.

The remaining Figures illustrate methods of utilizing the game apparatus 10 of FIG. 1. Although the methods illustrated are not exhaustive of all possible play configurations of the game apparatus, they are representative and illustrative of basic methods of utilizing the game apparatus.

Figure 2:
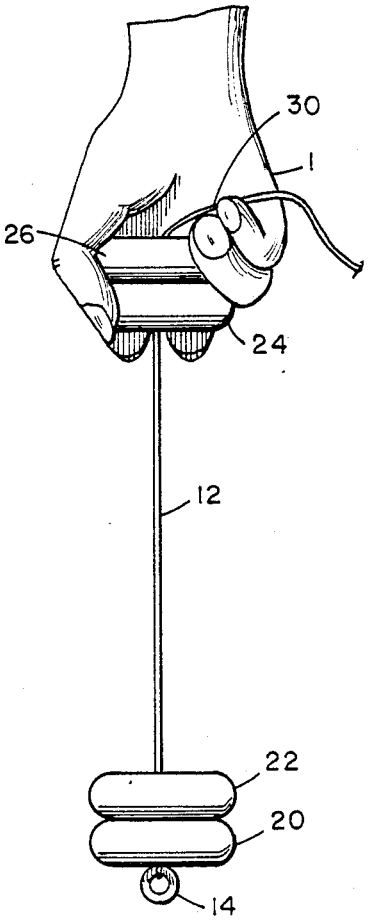
FIG. 2 is an elevation view of a user holding the game apparatus preparatory to executing a basic play pattern.
Figure 3:
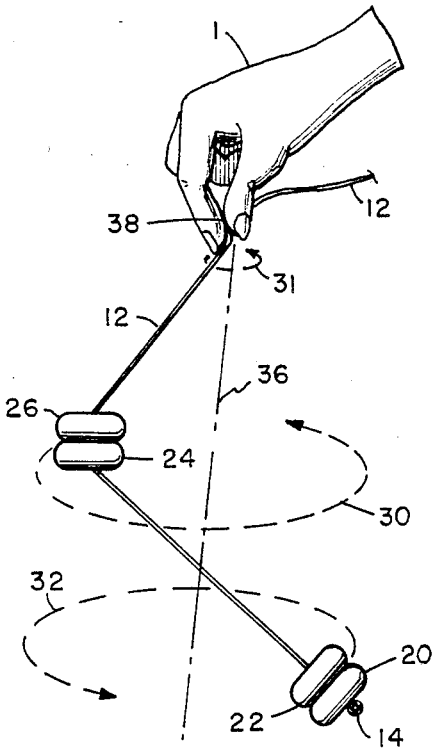
FIG. 3 is an elevation view of the game apparatus being manipulated by the user in a basic play pattern derived from the starting position of FIG. 2.

With reference to FIGS. 2 and 3, the initiation of a basic play pattern and the established basic play pattern are respectively illustrated. In FIG. 2, the upper two disks 24 and 26 are aligned and grasped in user's hand 1, and conveniently with the index and middle finger flanking the central opening of disk 24. The flexible cord 12 is gripped at 30 above the disk 26 by the ring and/or little finger, and a portion of the flexible cord 12 extends downwardly and supports the disks 20 and 22 a distance below the hand 1. With the dimensions of the preferred embodiment game apparatus 10 set forth above, the distance between disk 24 and end stop 14 may be approximately two feet for satisfactory results. While continuing to hold the flexible cord 12, the upper two disks 24 and 26, disk 24 being the next adjacent disk to disk 22, are released from the hand while simultaneously imparting a horizontal circular motion to the said disks 24 and 26. At this point, it may prove convenient to the user to grip cord 12 between the index finger and the thumb of hand 1, and in any event, a gentle horizontal circular motion is continuously applied to the gripped point of the flexible cord, as indicated at 31, resulting in the play pattern shown in FIG. 3. More specifically, in the transition from the start position of FIG. 2 to the play pattern of FIG. 3, the upper blocks 24 and 26 slide partway down the flexible cord 12 and revolve in a generally horizontally, generally circular path indicated by the dotted lines 32. The lower disks 22 and 24 are also established in a generally horizontal, generally circular revolving path 34, with the disks 20 and 22 being approximately 180 degrees out of phase with the disks 24 and 26, i.e., the center of mass of all of the disks is along an axis 36 at the center of the paths of revolution.

The pattern of play illustrated in FIG. 3 may be maintained by continuing the small horizontal circular motion of the hand, and more particularly the motion is most easily generated by the finger and the thumb grasping the upper end of the flexible cord 12 at 38. The speed of rotation may be varied, causing the circular paths to become closer together, until the blocks appear to the eye to be revolving in a common plane, or decreased, until the centrifugal force is insufficient to maintain disks 24, 26 at the position shown and disks 24, 26 slide down to join disks 20, 22.

An alternative way of establishing the basic play pattern of FIG. 3 is to grasp the cord 12 with all four disks and approximately eight inches of string depending from the user's hand. Moving the finger and thumb grasping the cord in a gentle, small horizontal circular motion causes the upper two disks 24, 26 to separate from the lower two disks 20, 22. As the separation occurs, the user permits some of the excess cord to slip slowly between the fingers and thumb grasping the cord, thereby providing an additional length of depending cord and providing additional room for the disks to spin, until the pattern shown in FIG. 3 is established. It takes slightly more vigorous motion to cause separation of the disks than is necessary to keep them in motion, but in any event, the force is gentle and jerky motions of the block are an indication of excess or unsmooth application of force.

Figure 4:
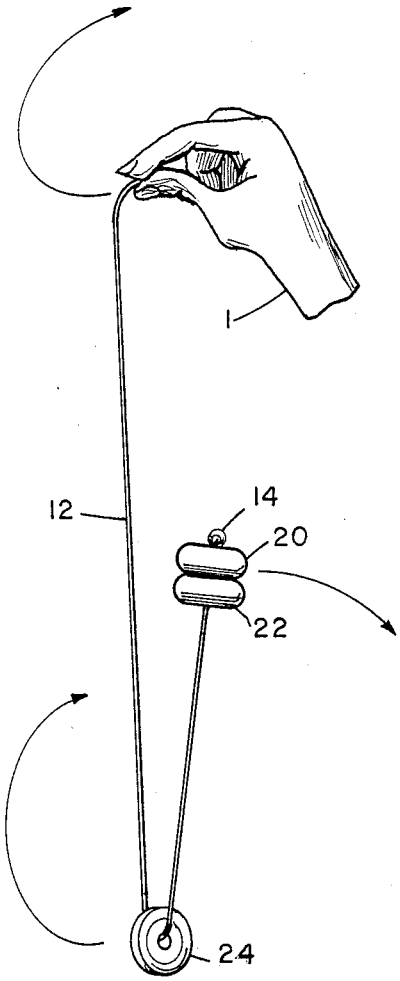
FIG. 4 is an elevation view of the game apparatus being manipulated by the user in a variation of the play pattern illustrated in FIG. 3.

With reference to FIG. 4, a first alternate play pattern of the game apparatus 10 is illustrated, with the disks 20, 22 and 24, 26 revolving in vertically oriented circular paths. This play pattern can be achieved by first establishing the basic play pattern illustrated in FIG. 3 and by adding a slight vertical component to the motion-inducing hand movement, causing the disks to be drawn toward a vertical orientation and increasing that vertical component until the vertical orientation of the paths of rotation is achieved. For sustaining the vertical pattern shown in FIG. 4 it is preferable to cause disks 20, 22 to pass on alternate sides of the flexible cord extending from the hand 1 to the upper disks 24, 26 on each revolution of the disks.

Figure 5:
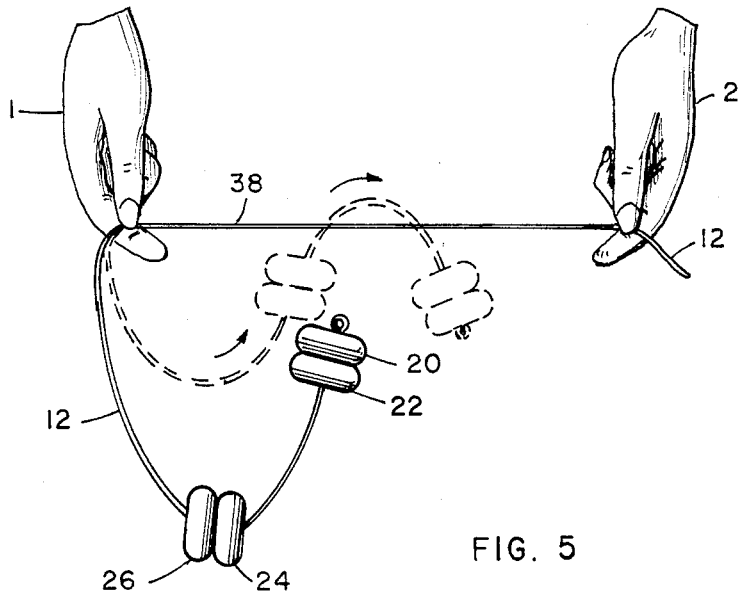
FIG. 5 is an elevation view of the game apparatus being manipulated by a user in yet another variation of the basic pattern illustrated in FIG. 3.

With reference to FIG. 5, the method of using the game apparatus 10 comprises a further variation achieved as a progression from the play pattern of FIG. 4. In FIG. 5, a portion 38 of the excess length of cord 12 (cord which merely trailed away from the grasp point in previous play patterns) is stretched taut between the user's hand 1 being using to grasp the cord and impart motion to the disks and the user's second hand 2. As the disks 20, 22 approach the upper portion of a vertical revolution per the play pattern of FIG. 4, hand 1 is manipulated to cease imparting the vertical revolving motion to the disks and instead flip the lower two disks 20, 22 over the taut portion 38 of the cord 12. In FIG. 5, the disks are shown in solid as they approach the taut portion 38 of cord 12 and in dotted as the lower disks 20, 22 go over it. The disks 24, 26 will follow the lower disks 20, 22 over the taut portion 38 of the cord, and the disks may then be allowed to settle into the play pattern of FIG. 3. Alternatively, the vertical motion may be allowed to settle down to horizontal in the opposite direction to that of FIG. 3.

Figure 6:
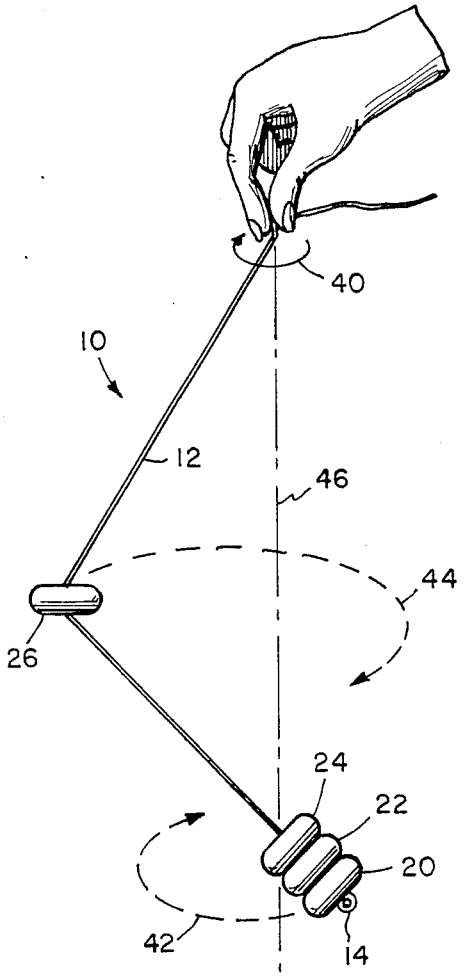
FIG. 6 is an elevation view of the game apparatus being manipulated by a user in an additional play pattern.

With reference to FIG. 6, there is illustrated another play pattern utilizing game apparatus 10 according to the method of the invention herein. In FIG. 6, the disks are separated into uneven groups, with disks 20, 22 and 24 adjacent the stop member 14. The remaining disk 26 is revolved at a spaced-apart location along cord 12, which is accomplished by starting the play pattern in a manner similar to that shown in FIG. 2 and discussed above except that only disk 26, being next adjacent disk 24, is held and given its initial circular motion by the user's hand. The user maintains the play pattern shown in FIG. 6 by moving his hand, or at least the finger and thumb thereof grasping the cord 12, in a small circular path as indicated at 40 which causes the lower combined disks 20, 22 and 24 to also move in a generally horizontal circular path shown by dotted line 42 and the disk 26 to also move in a generally horizontal circular path shown by dotted lines 44, spaced upwardly therefrom. It will be seen and appreciated that the circular paths are of differing size such that the center of mass of the four disks remains approximately on an axis of revolution 46. The play pattern of FIG. 6 may be further varied by regrouping the disks, with the disk 20 adjacent the stop member 14 and the disks 22, 24 and 26 together established in a spaced-apart generally horizontal and generally circular path of revolution.

Figure 7:
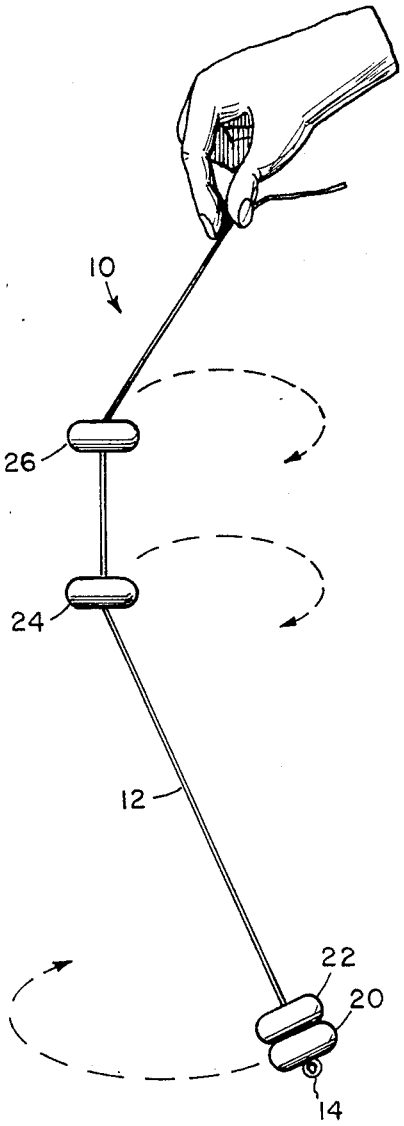
FIG. 7 is an elevation view of the game apparatus being manipulated by a user in a further play pattern.

Another variation in play pattern and method of play is illustrated in FIG. 7, with disks 20, 22 together positioned adjacent stop member 14 and established in a generally horizontal, circular path or orbit of revolution and disks 24, 26 also established in generally circular paths of revolution, spaced-apart and in phase with each other but out of phase with disks 20 and 22. The pattern of FIG. 7 is established in a manner similar to that illustrated in and described with respect to FIG. 2 above, except that only the next adjacent disk 24 is released initially and the disk 26 is released thereafter. The pattern illustrated in FIG. 7 is unstable in that the disks 24 and 26 eventually come together, and the challenge to the player is to first establish the pattern and to second maintain it for as long as possible.

Figure 8:
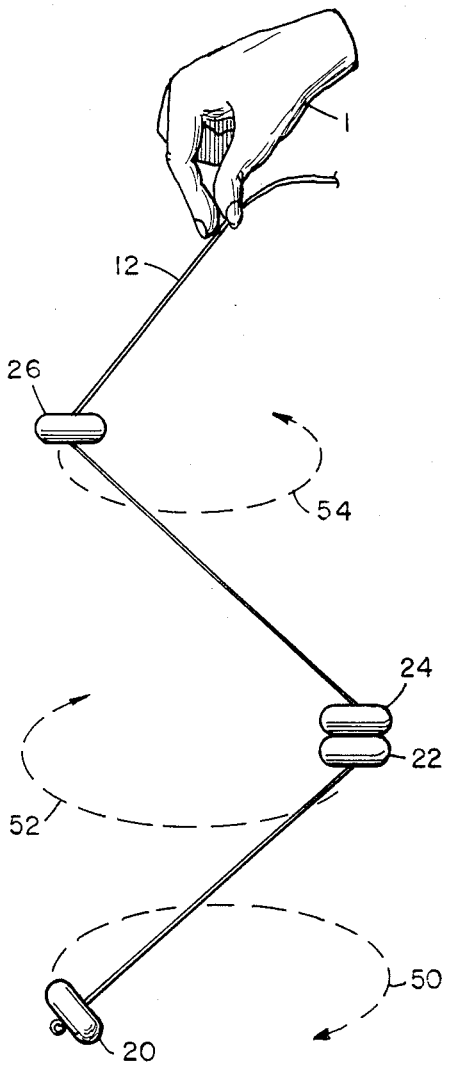
FIG. 8 is an elevation view of the game apparatus being manipulated by a user in another, unstable play pattern.

The foregoing methods of play and resultant play patterns are generally stable, i.e., they may be continued more or less indefinitely with correct input motion of the user, and even in the case of the play pattern illustrated in FIG. 7, an altered play pattern continues after the blocks 24 and 26 move together. There are other methods of play and resultant play patterns which are unstable and break down into uncontrollable motion of the game pieces, but are nevertheless entertaining both in terms of the skill necessary to begin them and the aesthetics of the play patterns themselves, albeit short lived. An example of such a play pattern is illustrated in FIG. 8, wherein the disk 20 and the disks 22, 24 are established in spaced-apart, out of phase generally circular paths of revolution 50 and 52 respectively, similarly to the patterns discussed in FIGS. 3 and 6 above. However, the fourth disk 26 is established in a counter-rotating generally circular path of revolution 54 by a reversal of the circular hand motion and simultaneous release of the disk 26. Because there is no further input motion to maintain the patterns by disk 20 and disks 22, 24, the play pattern shown in FIG. 8 is achieved for only a short duration of time. Other such unstable patterns of play are available to the user through his imagination and experience in utilizing the game apparatus 10.

Figure 9:
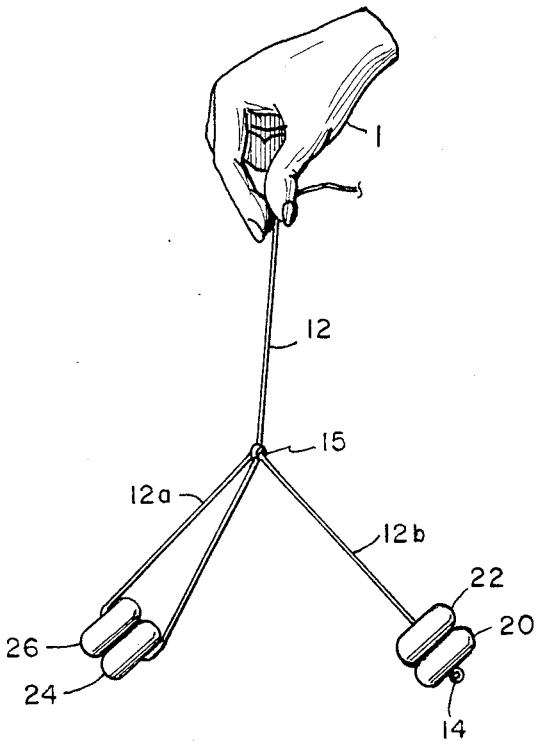
FIG. 9 is an elevation view of the game apparatus in altered configuration being manipulated by a user in a play pattern.

FIG. 9 illustrates that the game apparatus itself may be reconfigured to achieve alternate patterns of play. The disks 20, 22 are positioned adjacent the stop member 14, and the flexible cord 12 extends upwardly therefrom. A loop 12*a* of the cord is formed at a point spaced-apart from the stop member 14 and is secured to the cord at the knot 15, the loop 12*a* passing through the central openings of disks 24 and 26. Disks 20 and 22 are deployed on portion 12*b* of cord 12, extending from the knot 15 to the stop member 14. Portions 12*a* and 12*b* are of slightly different length, so that the knot is offset with respect to the center of mass of the disks. A gentle circular motion of the user's hand on the free end of the flexible cord 12 establishes the disks in a generally circular orbit, as illustrated.

Accordingly, there has been described a game which requires skill to play and which occupies and entertains people. The game apparatus disclosed is capable of use in a variety of play patterns, and the skill, imagination and ingenuity of the users will undoubtedly supply more variations. It will be appreciated that various changes may be made in the preferred embodiment disclosed above, including provision of a different number of disks or other shaped game pieces on the flexible cord, with accompanying variations in patterns of the game pieces. Another beneficial but temporary modification is to tie the blocks in spaced-apart locations along the flexible cord according to the desired pattern for training purposes, and to spin the game pieces in the desired pattern while they are held in position on the cord prior to attempting the same patterns with the game pieces freely slideable on the cord. Therefore, the scope of the invention is limited only by the following claims.

I claim:

1. A game apparatus comprising:

(A) an elongated flexible cord having a first, free end and a second hand-held end unencumbered by a handle or the like;

(B) four game pieces of substantially the same size and configuration, each game piece having an opening therein through which the flexible cord passes, the flexible cord being loosely accommodated in said opening; and (C) a stop member secured to the first, free end of the flexible cord, the stop member being larger than the opening in the game piece adjacent thereto, wherein the plurality of game pieces are slideably received along the flexible cord and are prevented from sliding off the free end thereof by the stop member, whereby the game pieces may be manipulated into a plurality of revolving configurations while the player grasps the elongated flexible cord at a point spaced apart fr0m the first free end thereof.

2. A game apparatus as defined in claim 1 wherein a loop is formed in the flexible cord, said loop passing through at least the upper game piece and said loop being tied into the flexible cord at a point spaced-apart form the stop member.

3. A game apparatus as defined in claim 1 wherein the game pieces are disks and the opening in each disk is a central axial opening.

4. A game apparatus as defined in claim 3 wherein the disks have a diameter in the range of from one (1) centimeter to fifteen (15) centimeters.

5. A game apparatus as defined in claim 4 wherein the thickness of the disks is in the range form one-half (½) centimeter to eight (8) centimeters.

6. A game apparatus as defined in claim 5 wherein the diameter of the disks is approximately five (5) centimeters and the thickness of the disks is approximately two (2) centimeters.

7. A game apparatus as defined in claim 6 wherein the disks are fabricated of wood.

8. A game apparatus as defined in claim 6 wherein the flexible cord is at least four feet in length.

9. A game apparatus as defined in claim 8 wherein the stop member comprises a game piece fixed to the end of the flexible cord.

10. A game apparatus as defined in claim 8 wherein the stop member is an annular ring tied to the flexible cord.

11. A game apparatus as defined in claim 1 wherein the game pieces are disks and the opening in each disk is a central axial opening.

12. A game apparatus as defined in claim 1 wherein the stop member comprises a game piece fixed to the end of the flexible cord.

13. A game apparatus as defined in claim 1 wherein the stop member is an annular ring tied to the flexible cord.

14. A game apparatus comprising:

(A) a elongated flexible cord;

(B) four game pieces each having an opening therein through which the flexible cord passes, the flexible cord being loosely accommodated therein; and (C) a stop member secured to a first, free end of the flexible cord, the stop member being larger than the opening in the game piece adjacent thereto, wherein the plurality of game pieces are slideably received along the flexible cord and are prevented from sliding off the free end thereof by the stop member and wherein a loop is formed in the flexible cord, said loop passing through at least the upper game piece and said loop being tied into the flexible cord at a point spaced apart from the stop member.

15. A method of playing a game wherein the game apparatus comprises an elongated flexible cord having a plurality of game pieces slideably received thereon and constrained from sliding thereof at one end of the cord, the method comprising:

(A) manually grasping the flexible cord at an intermediate position with at least one game piece supported on the depending free end of the cord while holding at least the next adjacent game piece in the same hand used for grasping the cord;

(B) moving the hand to cause the game piece(s) at the free end of the cord to revolve in a generally circular path;

(C) thereafter releasing at least the next adjacent one of the previously held game pieces; and (D) thereafter continuing to manipulate the held cord in a generally circular motion to cause the game pieces to near the free end of the cord to continue to revolve and to also establish revolving motion in a generally circular path in the released game piece.

16. A method of playing a game as defined in claim 15 wherein step (A) comprises supporting two game pieces on the depending free end of the cord while holding two game pieces and step (C) comprises thereafter releasing the two previously held game pieces.

17. A method of playing a game as defined in claim 16 wherein the step (D) includes manipulating the grasped cord in a circular motion with a vertical component to establish movement of the game pieces in generally circular, generally vertical paths of revolution.

18. A method of playing a game as defined in claim 17 and further including passing the two game pieces at the free end of the cord on opposite sides of the cord extending from the user's hand on successive revolutions.

19. A method of playing a game as defined in claim 17 and further comprising the steps of:

(E) thereafter holding a trailing portion of the cord taut between the manipulating hand and the other hand;

(F) manipulating the grasped cord to cause the game pieces to pass sequentially over the taut trailing portion of the cord; and (G) thereafter manipulating the grasped cord to cause the game pieces to revolve in generally circular, generally horizontal paths.

20. A method of playing a game as defined in claim 19 wherein step (G) includes causing the game pieces to revolve in a generally circular, generally horizontal path opposite to the first direction of revolution.

21. A method of playing a game as defined in claim 15 wherein step (A) comprises supporting three game pieces on the depending free end of the cord while holding one game piece and step (C) comprises releasing the one held game piece.

22. A method of playing a game as defined in claim 15 wherein step (A) comprises supporting one game pieces on the depending free end of the cord while holding three game pieces and step (C) comprises releasing the three held game pieces.

23. A method of playing a game as defined in claim 15 wherein step (A) comprises supporting two game pieces on the depending free end of the cord while holding two game pieces and step (C) comprises releasing the next adjacent held game piece, and further comprising thereafter releasing the remaining held game piece.

24. A method of playing a game as defined in claim 15 wherein step (A) comprises supporting two game pieces on the depending free end of the cord while holding two game pieces and step (C) comprises releasing the next adjacent held game piece, and further comprising:

(E) thereafter releasing the remaining held game piece and simultaneously imparting a motion of revolution in the direction opposite to the direction of revolution of the three revolving game pieces, whereafter the play pattern becomes unstable and terminates.

* * * * *